US012790672B2

(12) United States Patent
Dauvin

(10) Patent No.: US 12,790,672 B2
(45) Date of Patent: Nov. 10, 2026

(54) GRADE OF DUCTILE IRON WITH REINFORCED FERRITIC MATRIX

(71) Applicant: Sediver, Courbevoie (FR)

(72) Inventor: François Dauvin, Dissay-sous-Courcillon (FR)

(73) Assignee: Sediver, Courbevoie (FR)

( * ) Notice: Subject to any disclaimer, the term of this patent is extended or adjusted under 35 U.S.C. 154(b) by 321 days.

(21) Appl. No.: 18/719,790

(22) PCT Filed: Dec. 9, 2022

(86) PCT No.: PCT/EP2022/085250
§ 371 (c)(1),
(2) Date: Jun. 13, 2024

(87) PCT Pub. No.: WO2023/110683
PCT Pub. Date: Jun. 22, 2023

(65) Prior Publication Data

US 2025/0122600 A1 Apr. 17, 2025

Related U.S. Application Data

(63) Continuation-in-part of application No. PCT/FR2021/052293, filed on Dec. 13, 2021.

(30) Foreign Application Priority Data

Dec. 13, 2021 (WO) ..... PCT/FR2021/052293

(51) Int. Cl.
*C22C 37/04* (2006.01)
*C21C 1/10* (2006.01)
(Continued)

(52) U.S. Cl.
CPC ..... *C22C 37/04* (2013.01); *C21C 1/105* (2013.01); *C22C 33/08* (2013.01); *C22C 37/10* (2013.01);
(Continued)

(58) Field of Classification Search
None
See application file for complete search history.

(56) References Cited

U.S. PATENT DOCUMENTS 2,494,238 A 1/1950 Griggs et al.
5,098,651 A 3/1992 Ivo
(Continued)

FOREIGN PATENT DOCUMENTS

EP 2765207 A1 8/2014
EP 3243920 A1 11/2017
(Continued)

OTHER PUBLICATIONS

Lacaze, J., Sertucha, J., Magnusson Aberg, L. Microstructure of As-cast Ferritic-pearlitic Nodular Cast Irons ISIJ International, vol. 56 (2016), No. 9, pp. 1606-1615 (Year: 2016).*
(Continued)

*Primary Examiner* — Alexandra M Moore
(74) *Attorney, Agent, or Firm* — TraskBritt

(57) ABSTRACT

A grade of ductile cast iron having a tensile strength (Rm) equal to or greater than 700 MPa, an elongation at break equal to or greater than 11%, a yield strength ($Rp_{0.2}$) equal to or greater than 532 MPa, and a minimum ratio of yield strength ($Rp_{0.2}$) to tensile strength (Rm) of 76% in a tensile test performed on a specimen taken from a tensile bar in accordance with standard EN 1563 and having a diameter of 25 mm and a length of 200 mm.

13 Claims, 1 Drawing Sheet

(51) Int. Cl.
*C21D 5/00* (2006.01)
*C22C 33/08* (2006.01)
*C22C 37/10* (2006.01)

(52) U.S. Cl.
CPC ..... *C21D 5/00* (2013.01); *C21D 2211/005* (2013.01)

(56) References Cited

U.S. PATENT DOCUMENTS

| | | | |
|---|---|---|---|
| 2012/0283563 | A1 | 11/2012 | Moore et al. |
| 2014/0251751 | A1 | 9/2014 | Park |
| 2014/0271330 | A1 | 9/2014 | Horiya et al. |
| 2016/0100852 | A1 | 4/2016 | Hyde et al. |
| 2017/0131311 | A1 | 5/2017 | Flagle et al. |
| 2018/0274066 | A1 | 9/2018 | Papis et al. |
| 2022/0370024 | A1 | 11/2022 | Knowland et al. |

FOREIGN PATENT DOCUMENTS

| | | | | |
|---|---|---|---|---|
| EP | 3243920 | B1 * | 4/2020 | ..... C22C 37/08 |
| FR | 2654961 | A1 | 5/1991 | |
| FR | 2908283 | A1 | 5/2008 | |
| WO | WO-2018093894 | A1 * | 5/2018 | ..... C22C 37/10 |
| WO | 2018/102713 | A2 | 6/2018 | |

OTHER PUBLICATIONS

French Search Report for Application No. 2305857 dated Apr. 9, 2024, 3 pages.

International Standard ISO 945-1, Third Edition, Microstructure of Cast Irons, Part 1: Graphite classification by visual analysis, Technical Committee ISO/TC 25, (2019), 42 pages.

European Standard NF EN 1563, Founding—Spheroidal Graphite Cast Irons, Aug. 2018, 51 pages.

International Search Report for International Application No. PCT/EP2022/085250, mailed Mar. 13, 2023, 7 pages. (3 pages of English Translation and 4 pages of Original Document).

International Search Report for International Application No. PCT/FR2021/052293, mailed Jul. 18, 2022, 7 pages. (3 pages of English Translation and 4 pages of Original Document).

International Written Opinion for International Application No. PCT/EP2022/085250, mailed Mar. 13, 2023, 4 pages of Original Document Only.

International Written Opinion for International Application No. PCT/FR2021/052293, mailed Jul. 18, 2022, 12 pages. (6 pages of English Translation and 6 pages of Original Document).

* cited by examiner

GRADE OF DUCTILE IRON WITH REINFORCED FERRITIC MATRIX

CROSS REFERENCE TO RELATED APPLICATIONS

This application is a national phase entry under 35 U.S.C. § 371 of International Patent Application PCT/EP2022/085250, filed Dec. 9, 2022, designating the United States of America and published as International Patent Publication WO 2023/110683 A1 on Jun. 22, 2023, which is a continuation in part of International Patent Application Serial No. PCT/FR2021/052293, filed Dec. 13, 2021.

TECHNICAL FIELD

The field of the present disclosure is that of ductile or spheroidal graphite (SG) cast irons with a strengthened ferritic (predominantly ferritic) matrix.

BACKGROUND

Ductile cast irons or spheroidal graphite, SG, cast irons standardized to European standard EN 1563 and known as strengthened ferritic matrix cast irons are characterized by the following mechanical properties: tensile strength (Rm) in MPa, elongation at break (A) in %, and yield strength ($Rp_{0.2}$, i.e., the value of the stress at which there is 0.2% remaining plastic deformation) in MPa. The ratio of yield strength to tensile strength is also an indicator of quality for ductile cast irons. The table below lists the various standardized (EN1563) strengthened ferritic matrix SG cast irons, along with their properties and structures.

| Designation | $R_m$ (MPa) | $Rp_{0.2}$ (MPa) | A % | Matrix structure |
|---|---|---|---|---|
| EN-GJS-450-18 | 450 | 350 | 18 | Strengthened ferritic |
| EN-GJS-500-14 | 500 | 400 | 14 | Strengthened ferritic |
| EN-GJS-600-10 | 600 | 470 | 10 | Strengthened ferritic |

These cast irons have very advantageous properties in terms of elongation at break, but their tensile strength is always below 700 MPa.

Conventional ductile cast irons, which are also standardized (EN1563), are known to have excellent tensile strengths of up to 700 MPa (see table below-grade EN-GJS-700-2), with the elongation at break then limited to 2%.

| Designation | $R_m$ (MPa) | $Rp_{0.2}$ (MPa) | A % | Matrix structure |
|---|---|---|---|---|
| EN-GJS-700-2 | 700 | 420 | 2 | Pearlitic |
| EN-GJS-600-3 | 600 | 370 | 3 | Pearlitic |
| EN-GJS-500-7 | 500 | 320 | 7 | Pearlitic-ferritic |
| EN-GJS-400-15 | 400 | 250 | 15 | Ferritic |
| EN-GJS-350-22 | 350 | 220 | 22 | Ferritic |

It can be seen that the ductile grades currently available do not offer both tensile strength values Rm greater than or equal to 700 MPa and elongation at break greater than or equal to 8%, 10% or even 11%, and do so with a high ratio of yield strength to tensile strength, typically greater than 75%.

BRIEF SUMMARY

The present disclosure aims to overcome the above-mentioned drawbacks by providing a ductile cast iron with a strengthened ferritic matrix that has a tensile strength at least comparable with ductile cast irons with a pearlitic structure (typically greater than or equal to 700 MPa), with an elongation at break greater than or equal to 11%, and additionally an $Rp_{0.2}$/Rm ratio greater than 76%. The present disclosure also relates to a method for producing such a ductile cast iron.

The present disclosure relates to a ductile cast iron with a strengthened ferritic matrix that has a tensile strength (Rm) equal to or greater than 700 MPa, an elongation at break equal to or greater than 11%, a yield strength ($Rp_{0.2}$) equal to or greater than 532 MPa, and a ratio of yield strength ($Rp_{0.2}$) to tensile strength (Rm) equal to or greater than 76% in a tensile test performed on a specimen taken from a tensile bar in accordance with standard EN 1563 and having a diameter of 25 mm and a length of 200 mm.

The ductile cast iron according to the present disclosure has the following composition, the content of the various elements being in percentages by weight:

- a carbon content of between 2.8% and 4.5%;
- a silicon content of between 3% and 5%;
- a manganese content of between 0.1% and 0.8%;
- a sulfur content of less than 0.01%;
- a phosphorus content of between 0.001% and 0.05%;
- a copper content of between 0.1% and 1%, preferably between 0.1% and 0.8%, and even more preferably between 0.1% and 0.7%;
- a magnesium content of less than 0.1%;
- a nickel content of between 0% and 1%;
- a chromium content of between 0% and 1%;
- impurities of less than 0.2%, these impurities coming, in particular, from the materials and equipment used in the method for producing the cast iron; and
- the remainder to reach 100% being made by the iron content.

According to the present disclosure, this grade of cast iron first affords a significant improvement in elongation at break, while retaining excellent tensile strength, compared with the ductile cast irons of the prior art. It also affords decreased loss of mechanical properties as a result of increasing the thickness of the manufactured part, i.e., low sensitivity to thickness. The ratio of yield strength to tensile strength, which exceeds 76% for the present grade, is also a significant advantage.

The present disclosure also covers a method for preparing a ductile cast iron with a strengthened ferritic matrix for producing a cast part, the method comprising the following steps:

- preparing a raw material that contains carbon, silicon, manganese,
- sulfur, phosphorus, copper, magnesium and iron, and potentially nickel and chromium;
- melting the raw material;
- inoculating the raw material;
- applying a spheroidizing treatment; and
- casting the inoculated material.

The ductile cast iron obtained has a tensile strength (Rm) equal to or greater than 700 MPa, a yield strength equal to or greater than 532 MPa and a minimum ratio of yield strength ($Rp_{0.2}$) to tensile strength (Rm) of 76% in a tensile test performed on a specimen taken from a tensile bar in accordance with standard EN 1563 and having a diameter of 25 mm and a length of 200 mm; the ductile cast iron further has an elongation at break equal to or greater than 11%.

The inoculated material consists (in percentage by weight) of 2.8% to 4.5% carbon, and 3% to 5% silicon, 0.1% and 0.8% manganese, less than 0.01% sulfur, 0.001% to 0.05% phosphorus, 0.1% to 1% copper, less than 0.1% magnesium, 0% to 1% nickel. 0% to 1% chromium, iron and unavoidable impurities.

Preferentially, the copper content is between 0.1% and 0.8%, advantageously between 0.1% and 0.7%.

The inoculation step is carried out once, twice, three or four times.

The spheroidizing treatment is advantageously carried out until a proportion of form VI graphite particles of greater than 90%, or even greater than 95%, is obtained.

The present disclosure also includes a method for producing a cast part, wherein the cast part does not undergo any heat treatment, which makes the ductile cast iron of the present disclosure highly economically advantageous.

Lastly, the present disclosure relates to the use of the ductile cast iron in the production of a high-voltage power line insulator cap or to the production of cast mechanical parts in the fields of transport, mining or power generation.

BRIEF DESCRIPTION OF THE DRAWINGS

The present disclosure will be better understood and further advantages will become apparent from the following description and from the accompanying drawings, in which.

DETAILED DESCRIPTION

Figure 1:
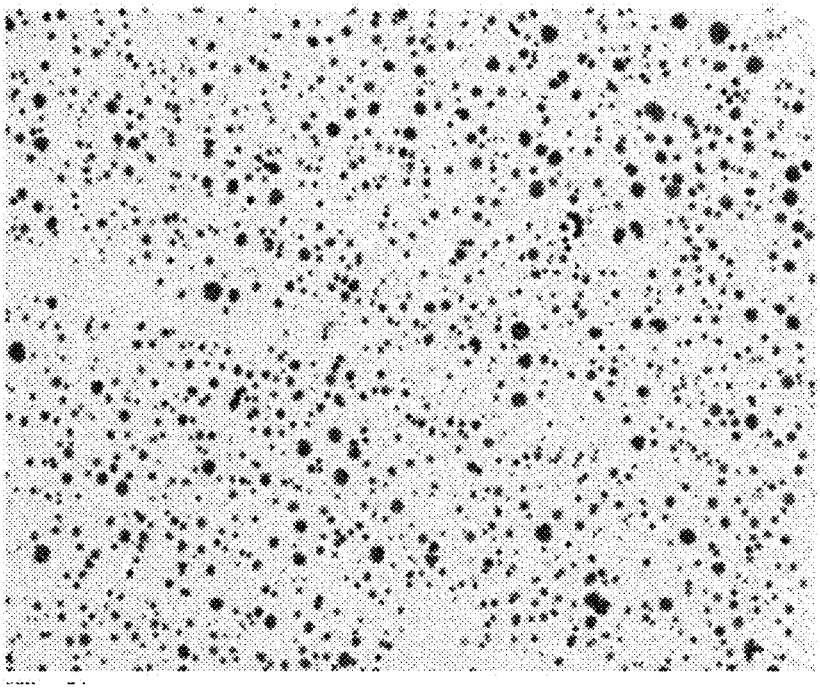
FIG. 1 is a microstructure image of an SG iron with a ferritic-pearlitic matrix according the present disclosure before nital etching.

The development of ductile spheroidal graphite (SG) cast irons with a strengthened ferritic matrix stems from the objective of manufacturers to reduce variations in the mechanical properties and the machinability costs of parts.

Known traditional ductile cast irons with a predominantly pearlitic microstructure matrix have the mechanical properties shown in Table 1 based on tests carried out with grade EN-GJS-600-3.

TABLE 1

| # | Rm (MPa) | $Rp_{0.2}$ (MPa) | A % | $Rp_{0.2}$/Rm (in %) |
|---|---|---|---|---|
| 1 | 713 | 508 | 8.4 | 71.2% |
| 2 | 646 | 452 | 11.8 | 70.0% |
| 3 | 689 | 495 | 9.8 | 71.8% |
| 4 | 708 | 500 | 8.8 | 70.6% |
| 5 | 719 | 512 | 8.3 | 71.2% |
| 6 | 686 | 485 | 9 | 70.7% |
| 7 | 721 | 512 | 8.2 | 71.0% |
| 8 | 646 | 452 | 11.8 | 70.0% |
| 9 | 686 | 480 | 9.3 | 70.0% |
| 10 | 725 | 511 | 8.2 | 70.5% |

In addition to iron, the composition of these cast irons contains the percentages by weight shown in Table 2 below.

TABLE 2

| wt % | C | Si | Mn | P | S | Cu | Mg |
|---|---|---|---|---|---|---|---|
| min | 3 | 2.1 | 0.1 | | | 0.2 | 0.02 |
| max | 4 | 3 | 0.5 | 0.1 | 0.05 | 0.7 | 0.06 |

Although the mechanical properties of these cast irons are already remarkable, they do not achieve very high values of tensile strength (greater than or equal to 700 MPa), yield strength ($Rp_{0.2}$/Rm greater than or equal to 76%) and elongation at break (greater than 8%, or even greater than or equal to 11%).

The mechanical characteristics of these predominantly pearlitic cast irons are also highly sensitive to the thickness of the part produced.

The ductile cast iron according to the present disclosure has a strengthened ferritic matrix. This means that its structure is predominantly ferritic (>70%) and that it can comprise pearlite in a minority proportion; the structure of the ductile cast iron according to the present disclosure can therefore also be described as a ferritic-pearlitic matrix.

The cast iron of the present disclosure achieves on average a tensile strength (Rm) greater than or equal to 700 MPa, a yield strength ($Rp_{0.2}$) greater than or equal to 532 MPa, a minimum ratio of yield strength ($Rp_{0.2}$) to tensile strength (Rm) of 76%, and an elongation at break that is always greater than 8% and even greater than or equal to 11% in tensile tests performed on a test specimen taken from a tensile bar in accordance with standard EN 1563 and with a diameter of 25 mm and a length of 200 mm. Four test results (A to D) are given in Table 3 below.

TABLE 3

| # | Rm (MPa) | $Rp_{0.2}$ (MPa) | A % | $Rp_{0.2}$/Rm (in %) |
|---|---|---|---|---|
| A | 725 | 557 | 11.5 | 76.8 |
| B | 710 | 556 | 11.5 | 78.3 |
| C | 718 | 559 | 13 | 77.8 |
| D | 709 | 539 | 12 | 77 |

In addition to iron (and unavoidable impurities), the composition of this grade of cast iron contains the percentages by weight shown in Table 4. The composition of a grade according to the present disclosure is also given, by way of example, in Table 4.

TABLE 4

| wt % | C | Si | Mn | P | S | Cu | Mg | Ni | Cr |
|---|---|---|---|---|---|---|---|---|---|
| min | 2.8 | 3 | 0.1 | 0.001 | 0 | 0.1 | 0 | 0 | 0 |
| max | 4.5 | 5 | 0.8 | 0.05 | 0.01 | 1 | 0.1 | 1 | 1 |
| Example | 3.17 | 4.30 | 0.22 | <0.012 | 0.0035 | 0.59 | 0.039 | 0 | 0 |

In the ductile cast iron according to the present disclosure, the silicon helps to strengthen the ferritic matrix; the percentage of copper is limited to the range [0.1%-1%], or even to the range [0.1%-0.8%] in order to control the proportion of pearlite in the matrix. Preferentially, the copper content is even limited to 0.7%.

Figure 2:
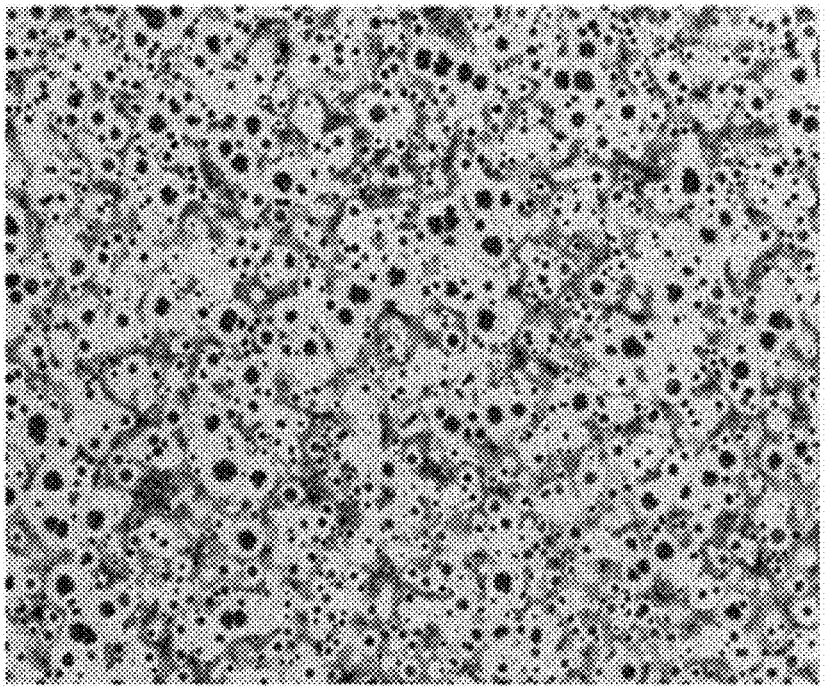
FIG. 2 is a microstructure image of an SG iron with a ferritic-pearlitic matrix according the present disclosure after nital etching.

This grade of ductile cast iron reveals a ferritic-pearlitic (predominantly ferritic) microstructure, as can be seen in FIG. 1 before etching with nital (a solution of nitric acid and alcohol commonly used for the chemical etching of ferrous metals) and in FIG. 2 after etching with nital.

By virtue of its ferritic or ferritic-pearlitic structure, the mechanical properties of the ductile cast iron are much less sensitive to the thickness of the part produced, which is a major industrial advantage.

To prepare a ductile cast iron according to the present disclosure for the production of cast parts, the method first comprises a step of preparing a raw material containing carbon, silicon, manganese, sulfur, phosphorus, copper, magnesium, iron and potentially nickel and chromium, in the ranges of percentages by weight mentioned hereinabove. The method then comprises the steps of melting the raw material, inoculating the material, and applying a spheroidizing treatment, prior to the step of casting the inoculated material. These steps are carried out so that the ductile cast iron has a strengthened ferritic structure and the mechanical characteristics mentioned hereinabove, i.e., a tensile strength (Rm) greater than or equal to 700 MPa, a yield strength greater than or equal to 532 MPa, a minimum ratio of yield strength ($Rp_{0.2}$) to tensile strength (Rm) of 76% and an elongation at break greater than or equal to 11%.

The products for the inoculating treatment are those listed in conventional supplier catalogs, but require special attention in terms of both composition and particle size in order to obtain the Rm, $Rp_{0.2}$ and A mechanical characteristics mentioned hereinabove. In addition, the choice of inoculant must be matched to the spheroidizing treatment product (subsequent step). In particular, the active element in the inoculant (barium, strontium, zirconium) should be chosen according to the composition of the spheroidizing alloy.

The inoculation step can be carried out once, twice, three times or even four times. Typically, this is carried out each time molten metal is transferred, including in the melt stream feeding the molten metal into the mold and/or when placing an ingot in the pattern plate.

The products for the spheroidizing treatment are also those listed in conventional supplier catalogs, but require special attention in terms of both composition and particle size in order to obtain the Rm, $Rp_{0.2}$ and A mechanical characteristics mentioned hereinabove. The content of active elements, such as magnesium, calcium and rare earths, should be rigorously controlled. All conventional introducing processes for spheroidization (tundish cover, sandwich, in-mold, etc.) are applicable to the present method.

As can be seen in FIG. 1, the quality of spheroidization is very good when the proportion of form VI graphite particles is greater than 90%. It is optimal when the proportion of form VI graphite particles is greater than 95%, with 5% form V particles or less, i.e., 100% nodularity. Graphite particle counting can be carried out manually or by software. For the classification of graphite particles, reference is made here to standard NF-EN-945.

The magnesium content must also be sufficient, but less than 0.1%, to ensure that the graphite particles have a spheroidal character throughout the entire range of thicknesses of the parts, without being excessive.

The mechanical characteristics of the ductile cast iron according to the present disclosure are obtained, in particular, with a high density of graphite spheroids per unit polished surface, i.e., greater than $1000/mm^2$ of polished surface.

It should be noted here that the composition of the ductile cast iron according to the present disclosure falls within the ranges defined by the min and max limits at the end of the production process. During the various steps (providing the raw material, inoculation, spheroidization), it will therefore be ensured that the compounds are added in such a way as to observe the ranges in the melt that is ultimately obtained.

The method also relates to the production of a molded part that does not undergo any heat treatment. Heat treatments are usually applied to cast iron parts to correct microstructural imperfections: obtaining a molded part in ductile cast iron that has the desired structure and mechanical properties directly, without the need for heat treatment, is a major economic advantage.

The ductile cast iron according to the present disclosure is used for the production of cast mechanical parts, such as a high-voltage power line insulator cap, or for the production of cast mechanical parts in the fields of transport, mining or power generation.

It goes without saying that the present disclosure is not restricted to the embodiment described above, and may be modified without departing from the scope of the invention as defined by the following claims.

The invention claimed is:

1. A ductile cast iron with a strengthened ferritic matrix structure, wherein the strengthened ferritic matrix structure comprises more than 70% of ferrite, the ductile cast iron has a tensile strength (Rm) equal to or greater than 700 MPa, an elongation at break equal to or greater than 11%, a yield strength ($Rp_{0.2}$) equal to or greater than 532 MPa and a minimum ratio of yield strength ($Rp_{0.2}$) to tensile strength (Rm) of 76% in a tensile test performed on a specimen taken from a tensile bar in accordance with standard EN 1563 and having a diameter of 25 mm and a length of 200 mm, and in that the ductile cast iron is formed by the following elements, in percentage by weight:

carbon, between 2.8% and 4.5%;
silicon, between 3% and 5%;
manganese, between 0.1% and 0.8%;
sulfur, less than 0.01%;
phosphorus, between 0.001% and 0.05%;
copper, between 0.1% and 1%;
magnesium, less than 0.1%;
nickel, between 0% and 1%;
chromium, between 0% and 1%;
impurities, less than 0.2%; and
iron, making up 100%.

2. The ductile cast iron of claim 1, wherein the percentage by weight of silicon is between 4.3% and 5%.

3. The ductile cast iron of claim 1, wherein the percentage by weight of copper is between 0.1% and 0.8%.

4. The ductile cast iron of claim 3, wherein the percentage by weight of copper is between 0.1% and 0.7%.

5. A cast element in the form of a high-voltage power line insulator cap or a mechanical part configured for use in transport, mining or power generation, the cast element consisting essentially of a ductile cast iron according to claim 1.

6. A method for preparing a ductile cast iron according to claim 1, the method comprising:

preparing a raw material containing carbon, silicon, manganese, sulfur, phosphorus, copper, magnesium and iron;
melting the raw material;
inoculating the raw material;
applying a spheroidizing treatment; and
casting the inoculated material.

7. The method of claim 6, wherein the preparing the raw material further comprises forming the raw material to further contain at least one of nickel and chromium.

8. The method of claim 6, wherein the inoculating the raw material is carried out twice, three times or four times.

9. The method of claim 8, wherein the spheroidizing treatment is carried out until a proportion of form VI graphite particles of greater than 90% is obtained.

10. The method of claim 9, wherein casting the inoculated material comprises producing a cast part, wherein the method does not include application of a heat treatment to the cast part.

11. The method of claim 6, wherein the spheroidizing treatment is carried out until a proportion of form VI graphite particles of greater than 90% is obtained.

12. The method of claim 11, wherein the spheroidizing treatment is carried out until a proportion of form VI graphite particles of greater than 95% is obtained.

13. The method of claim 6, wherein casting the inoculated material comprises producing a cast part, wherein the method does not include application of a heat treatment to the cast part.

* * * * *